US010569594B2

(12) United States Patent
Chen

(10) Patent No.: US 10,569,594 B2
(45) Date of Patent: Feb. 25, 2020

(54) WRITING TOOL

(71) Applicant: SDI Corporation, Chang Hua (TW)

(72) Inventor: Szu-Yu Chen, Chang Hua (TW)

(73) Assignee: SDI CORPORATION, Chang Hua (TW)

( * ) Notice: Subject to any disclaimer, the term of this patent is extended or adjusted under 35 U.S.C. 154(b) by 0 days.

(21) Appl. No.: 16/056,722

(22) Filed: Aug. 7, 2018

(65) Prior Publication Data

US 2019/0084340 A1 Mar. 21, 2019

(30) Foreign Application Priority Data

Sep. 18, 2017 (TW) ..... 106131962 A

(51) Int. Cl.

| | |
|---|---|
| ***B43K 1/00*** | (2006.01) |
| ***B43K 8/02*** | (2006.01) |
| ***B43K 5/14*** | (2006.01) |
| ***B43K 8/00*** | (2006.01) |
| ***B43K 8/12*** | (2006.01) |
| ***B43K 5/18*** | (2006.01) |
| ***B43K 8/14*** | (2006.01) |
| ***B43K 8/03*** | (2006.01) |

(52) U.S. Cl.

CPC ..... *B43K 1/003* (2013.01); *B43K 5/14* (2013.01); *B43K 5/18* (2013.01); *B43K 8/022* (2013.01); *B43K 8/03* (2013.01); *B43K 8/12* (2013.01); *B43K 8/146* (2013.01)

(58) Field of Classification Search

CPC ..... B43K 1/003; B43K 1/006; B43K 1/00; B43K 8/022; B43K 8/02; B43K 8/024; B43K 8/026; B43K 1/015; B43K 5/14; B43K 8/03; B43K 8/12; B43K 8/146; B43K 5/18

See application file for complete search history.

(56) References Cited

U.S. PATENT DOCUMENTS 3,507,600 A 4/1970 Cress
3,922,100 A * 11/1975 Saito ..... B43K 8/003 401/199

(Continued)

FOREIGN PATENT DOCUMENTS

CN 104619514 A 5/2015
CN 107791716 A 3/2018

(Continued)

*Primary Examiner* — David J Walczak
(74) *Attorney, Agent, or Firm* — Alan D. Kamrath; Karin L. Williams; Mayer & Williams PC

(57) ABSTRACT

A writing tool has a pen tube, a capillary unit, and a dispensing unit. The capillary unit is mounted in the pen tube, and is connected to a nib. The dispensing unit is mounted in the pen tube, and has a communicating tube and a pressing segment connected to the communicating tube. The pressing segment has at least one connecting arm connected to the communicating tube. A dispensing interval is formed between the communicating tube and a periphery of the pressing segment. The communicating tube contacts the capillary unit to make the capillary unit form different compression densities via the pressing segment and the dispensing interval, thus facilitating dispensing ink downward easily through the dispensing interval and providing a better occlusion effect to further avoid ink leakage.

20 Claims, 20 Drawing Sheets

(56) References Cited

U.S. PATENT DOCUMENTS

| | | | | |
|---|---|---|---|---|
| 5,556,215 | A | 9/1996 | Hori | |
| 5,938,362 | A | 8/1999 | Bastiansen | |
| 6,086,279 | A * | 7/2000 | Yen | B43K 23/08 401/198 |
| 6,322,268 | B1 | 11/2001 | Kaufmann et al. | |
| 6,629,798 | B1 | 10/2003 | Fukami et al. | |
| 6,632,041 | B1 * | 10/2003 | Witz | B43K 8/06 401/198 |
| 7,578,631 | B2 * | 8/2009 | Kurita | B43K 8/06 401/198 |
| 2004/0109210 | A1 | 6/2004 | Yoshida | |
| 2007/0212159 | A1 | 9/2007 | Kurita et al. | |
| 2007/0251542 | A1 | 11/2007 | Tajima | |
| 2013/0004231 | A1 | 1/2013 | Nakatani et al. | |
| 2016/0288561 | A1 | 10/2016 | Hoshino | |
| 2018/0186172 | A1 | 7/2018 | Kurita | |

FOREIGN PATENT DOCUMENTS

| | | | |
|---|---|---|---|
| JP | S5869481 | U | 5/1983 |
| JP | H10236072 | A | 9/1998 |
| JP | 2006212884 | A | 8/2006 |
| JP | 2012030405 | A | 2/2012 |
| KR | 101413401 | B1 | 6/2014 |
| WO | WO2012157594 | A1 | 11/2012 |
| WO | WO2014041901 | A1 | 3/2014 |

* cited by examiner

WRITING TOOL

CROSS-REFERENCE TO RELATED APPLICATIONS

This application is based upon and claims priority under 35 U.S.C. 119 from Taiwan Patent Application No. 106131962 filed on Sep. 18, 2017, which is hereby specifically incorporated herein by this reference thereto.

BACKGROUND OF THE INVENTION

1. Field of the Invention

The present invention relates to a writing tool, and particularly to a writing tool that can smoothly dispense ink and avoid ink leakage.

2. Description of the Prior Arts

A conventional writing tool as shown in China Patent Publication No. CN102844199A discloses an applicator having a channel 5 in which an application liquid 7 is flowable. The channel 5 includes a protrusion 11, the protrusion 11 having a cavity 21 therein and at least two communication holes 13, 14 partially communicating with the cavity 21, thereby allowing the application liquid 7 and external air to be dispensed outwardly and introduced inwardly via the communication holes 13, 14, respectively.

However, in the first embodiment as shown in FIGS. 1 to 5 of the aforesaid '199 publication, the applicator is connected to an application-liquid-occlusion body 4 mainly via the protrusion 11, dispensing the application liquid 7 mainly via the first communication hole 13. The protrusion 11 does not apply pressure to a lateral portion of the application-liquid-occlusion body 4, such that said lateral portion is low in density. Thus, lateral occlusive force of the application-liquid-occlusion body 4 is too insufficient to occlude the application liquid 7. As a result, the application liquid 7 in the protrusion 11 may flow out from the second communication hole 14 and cause leakage.

In the sixth embodiment and the seventh embodiment as shown in FIG. 10 and FIG. 11 of the '199 publication, respectively, one said first communication hole 13 and a plurality of said second communication holes 14 are located at the front end of the protrusion 11. When an unusual condition, such as high temperature, happens, high inner pressure may cause the application liquid 7 to dispense rapidly and simultaneous liquid-gas exchange via multiple holes may enable dispensing too great of an amount of the application liquid 7 to the application-liquid-occlusion body 4 that it can effectively handle, thereby leading to leakage.

China Patent Publication No. CN104619514A discloses a writing tool having a supplying tube 7 therein. The supplying tube 7 has a protruding segment 71a and a non-protruding segment 71b at a dispensing end thereof. The protruding segment 71a compresses fibers of the wadding 6 to form a part of high fiber density, thereby making the ink cartridge 2 supply appropriate amount of ink to the wadding 6.

In said writing tool, the protruding segment 71a of the supplying tube 7 protrudes toward the pen tip 5, thereby compressing the wadding 6 to form parts of various densities. However, the non-protruding segment 71b located beside the protruding segment 71a is open to make the ink in the supplying tube 7 easily dispensed bilaterally outwards, but the ink may be dispensed rapidly from the non-protruding segment 71b to cause abnormality or leakage if the quality of the wadding 6 is not good or if the fiber density of the wadding 6 is too low. For this reason, the wadding 6 must have a high and precise fiber density, thus increasing the cost.

Although the conventional writing tools disclose the structure, namely the protruding segment, that can compress a cotton core, namely the application-liquid-occlusion body 4 or the wadding 6, for providing a better ink dispensing effect, the conventional structure still may cause the ink to be dispensed outward abnormally or cause the simultaneous liquid-gas exchange when the ink is being dispensed, such that the cotton core cannot handle the amount of the dispensed ink causing ink leakage. Therefore, the conventional writing tools still need to be improved.

SUMMARY OF THE INVENTION

To solve the problem that the protruding segment may cause lateral ink leakage and redundant ink dispensed to the cotton core of the conventional writing tool due to simultaneous liquid-gas exchange during ink dispensing, the main objective of the present invention is to provide a writing tool having a pressing segment and a dispensing interval on a communicating tube of a dispensing unit, and the dispensing unit applies different pressures to a capillary unit via the pressing segment and the dispensing interval in order to prevent ink from tending to be detained. In addition, the dispensing interval formed between the pressing segment and the communicating tube can effectively destroy surface tension of ink, thereby enhancing the dispensing efficiency of the ink. At the same time, an internal periphery of the communicating tube also stops lateral overflow of the ink, thereby avoiding the lateral ink leakage and abnormal ink dispensing.

The writing tool has a pen tube, an ink cartridge, a capillary unit, and a dispensing unit. The pen tube has a nib mounted to an end of the pen tube. The ink cartridge is mounted to another end of the pen tube, being opposite to the nib. The capillary unit is mounted in the pen tube and between the ink cartridge and the nib. An end of the capillary unit is connected to the nib. The dispensing unit is mounted in the pen tube and between the capillary unit and the ink cartridge, having a communicating tube, a pressing segment, and a dispensing interval. The communicating tube has an internal periphery, a channel, and a dispensing end. The channel is surrounded by the internal periphery. The dispensing end faces the nib. The pressing segment is mounted to the dispensing end, contacts the capillary unit, and has at least one abutting segment and at least one connecting arm. The at least one abutting segment has a supporting surface contacting the capillary unit. The at least one connecting arm connects the at least one abutting segment and the internal periphery. The dispensing interval is formed between the at least one abutting segment and the internal periphery.

The writing tool of the present invention provides the following functional improvements on the aforesaid conventional writing tools.

1. The communicating tube and the pressing segment of the dispensing unit enable the ink to flow from the communicating tube to the capillary unit via the dispensing interval. The pressing segment is connected to the communicating tube by the at least one connecting arm, so the pressing segment and the communicating tube can apply different compression densities to the capillary unit, thereby detaining the ink within different parts of the capillary unit. The pressing segment mainly applies an axial pressing force to the capillary unit, and said force is divided and distributed via the dispensing interval. After the ink is diffused to be dispensed, the air substitutes it, further restricting the simultaneous plentiful gas-liquid exchange. Thus, the ink leakage is reduced, the pressure of the capillary unit can be adjusted, and the surface tension of the ink is reduced, so that the ink is guided for smooth dispensing and an appropriate amount of ink is supplied for replacement.

2. The pressing segment is mounted within a dispensing passage of the communicating tube, and the dispensing interval is formed between the communicating tube and a periphery of the pressing segment, thereby forming a low-density region located between the dispensing unit and the capillary unit and corresponding to the dispensing interval in order to dispense the ink out easily. In addition, the pressing segment and the communicating tube press and enable the capillary unit to form a middle-density region and a high-density region, respectively, so the ink can be occluded by higher pressures and avoid leakage.

3. The communicating tube of the dispensing unit and the nib are not coaxial with each other, so the writing tool may tend to roll when laid flat, thus, facilitating the ink to flow to the nib and preventing the nib from getting insufficiently moistened while the ink is less supplied.

Preferably, the communicating tube and the nib are not coaxial with each other.

Preferably, the communicating tube has a dispensing surface. The supporting surface is closer to the nib than the dispensing surface. A supporting distance is formed between the dispensing surface and the supporting surface.

Preferably, the at least one abutting segment has a guiding surface. The guiding surface is located between the supporting surface and the dispensing surface. A guiding interval is formed between the dispensing surface and the guiding surface.

Preferably, the supporting surface and the guiding surface are both planar and perpendicular to a lengthwise direction of the communicating tube.

Preferably, the pressing segment further has a strengthening segment connected between the at least one abutting segment and the internal periphery of the communicating tube.

Preferably, an inner high-density region is formed within the capillary unit where the capillary unit is pressed by the communicating tube. The pen tube further has a pressing portion formed at an inner side thereof for pressing the capillary unit. An outer high-density region is formed on the capillary unit where the capillary unit is pressed by the pressing portion.

Preferably, the pressing portion has a plurality of first segments and second segments abutting the first segments, respectively. The first segments are closer to the nib than the second segments. A distance for which each of the first segments of the pressing portion protrudes inward is constant. A distance for which each of the second segments of the pressing portion protrudes inward gradually increases toward the nib; namely, an inclined or arc-shaped portion is formed between two ends of each second segment lengthwise.

Preferably, the dispensing surface is non-perpendicular to a lengthwise direction of the pen tube and is an unlevel surface to have a lowest part and a highest part. A height difference is formed between the lowest part and the highest part.

Preferably, an outer surface of the at least one connecting arm and an outer surface of the at least one abutting segment are coplanar.

Preferably, the ink cartridge is detachably mounted to the pen tube.

Preferably, the supporting surface of the pressing segment extends beyond an end edge of the dispensing end of the communicating tube.

Preferably, the at least one abutting segment of the pressing segment elastically abuts the capillary unit.

Preferably, the dispensing interval is provided with a width defined between the internal periphery of the communicating tube and a periphery of the at least one abutting segment. The width is equal to or larger than 0.1 mm, and is smaller than an inner diameter of the communicating tube.

Preferably, the at least one abutting segment includes at least one protrusion extending toward the internal periphery of the communicating tube and the at least one protrusion has a distal side proximal to the internal periphery of the communicating tube. An abutting length is defined by a distance between two opposite points located at the distal side of the at least one protrusion of the at least one abutting segment, is equal to or larger than 0.1 mm, and is smaller than the inner diameter of the communicating tube.

Preferably, the supporting surface is non-perpendicular to a lengthwise direction of the communicating tube.

Preferably, the at least one connecting arm is sectionally L-shaped and has two ends, one of which is connected to a bottom of the at least one abutting segment and the other extends further into the communicating tube to be connected to the internal periphery of the communicating tube.

Preferably, the at least one abutting segment has at least one notch formed at a side thereof, and the dispensing interval communicates with the at least one notch.

Preferably, the at least one abutting segment is shaped like a cone.

Preferably, the at least one abutting segment is shaped like a vortex sectionally.

DETAILED DESCRIPTION OF THE PREFERRED EMBODIMENTS

Figure 1:
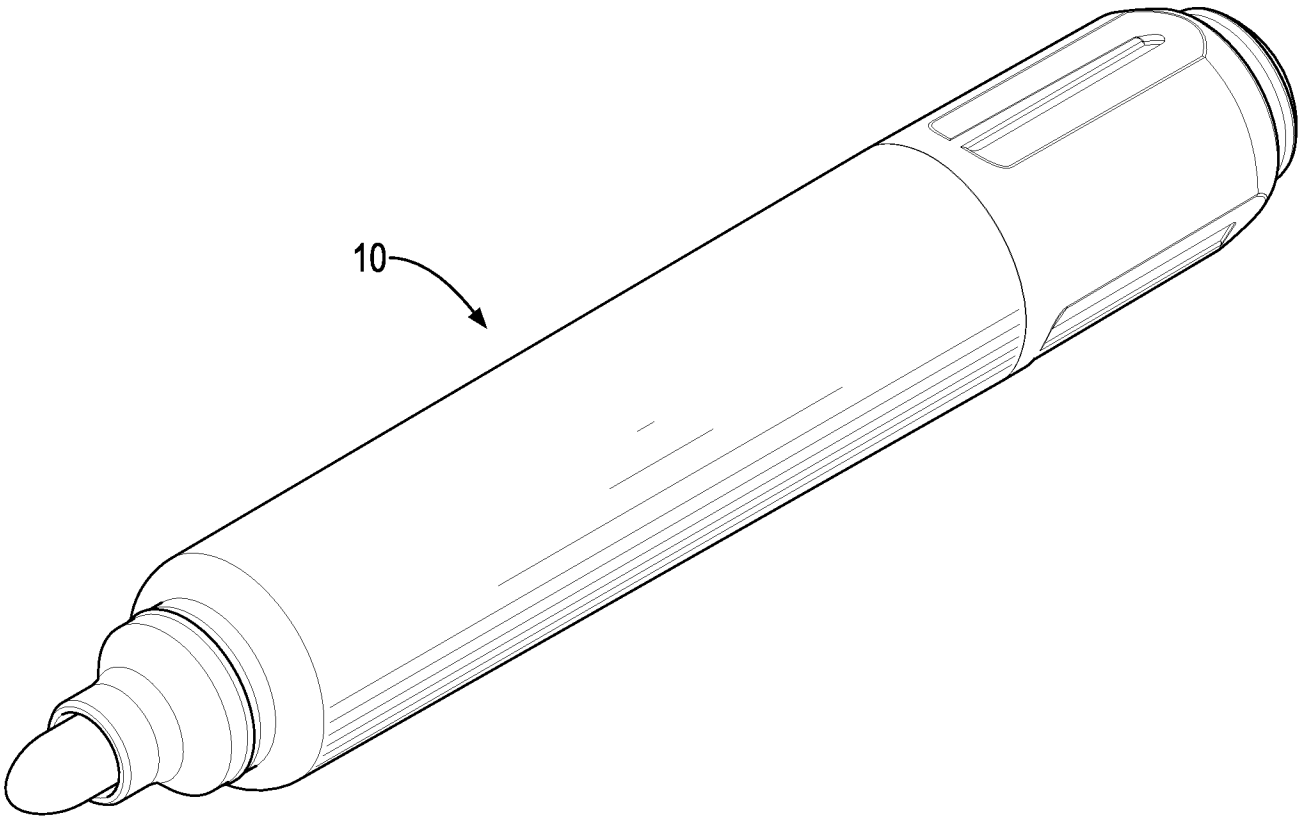
FIG. 1 is a perspective view of a writing tool in accordance with a first preferred embodiment of the present invention.

With reference to FIGS. 1, 2, 6, and 7, a writing tool constructed in accordance with a first preferred embodiment of the present invention includes a pen tube 10, an ink cartridge 20, a capillary unit 30, and a dispensing unit 40.

The pen tube 10 has a first end 11, a second end 12, and a nib 13. The pen tube 10 is a tube extending lengthwise. The first end 11 and the second end 12 are defined as two opposite ends of the pen tube 10, respectively. The nib 13 is mounted to the first end 11 of the pen tube 10. The pen tube 10 includes an internal periphery 14 between the first end 11 and the second end 12. In a preferred embodiment, the pen tube 10 further includes a pressing portion 15 formed on the internal periphery 14 and located adjacent to the first end 11. The pressing portion 15 includes a plurality of protrusive ribs 151 protruding inwardly from the internal periphery 14 of the pen tube 10.

Figure 2:
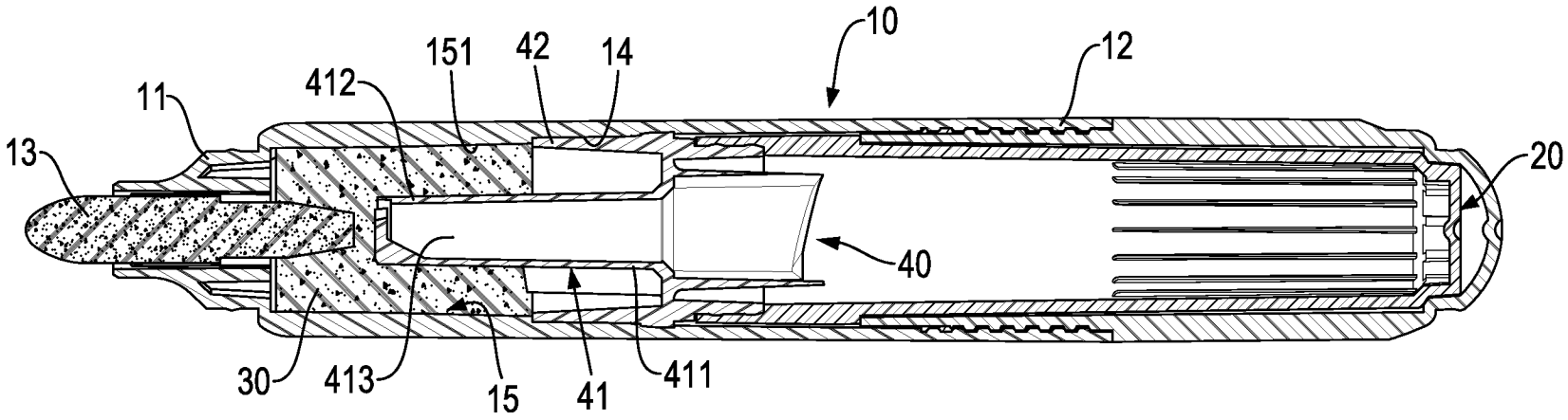
FIG. 2 is a front sectional view of the writing tool.

With reference to FIG. 2, the ink cartridge 20 is detachably mounted to the second end 12 of the pen tube 10. When ink stored in the ink cartridge 20 is exhausted, the ink cartridge 20 can be replaced with a new one and a sealing film of the new ink cartridge 20 can be pierced through to allow ink in to flow out from the new ink cartridge 20.

Figure 3:
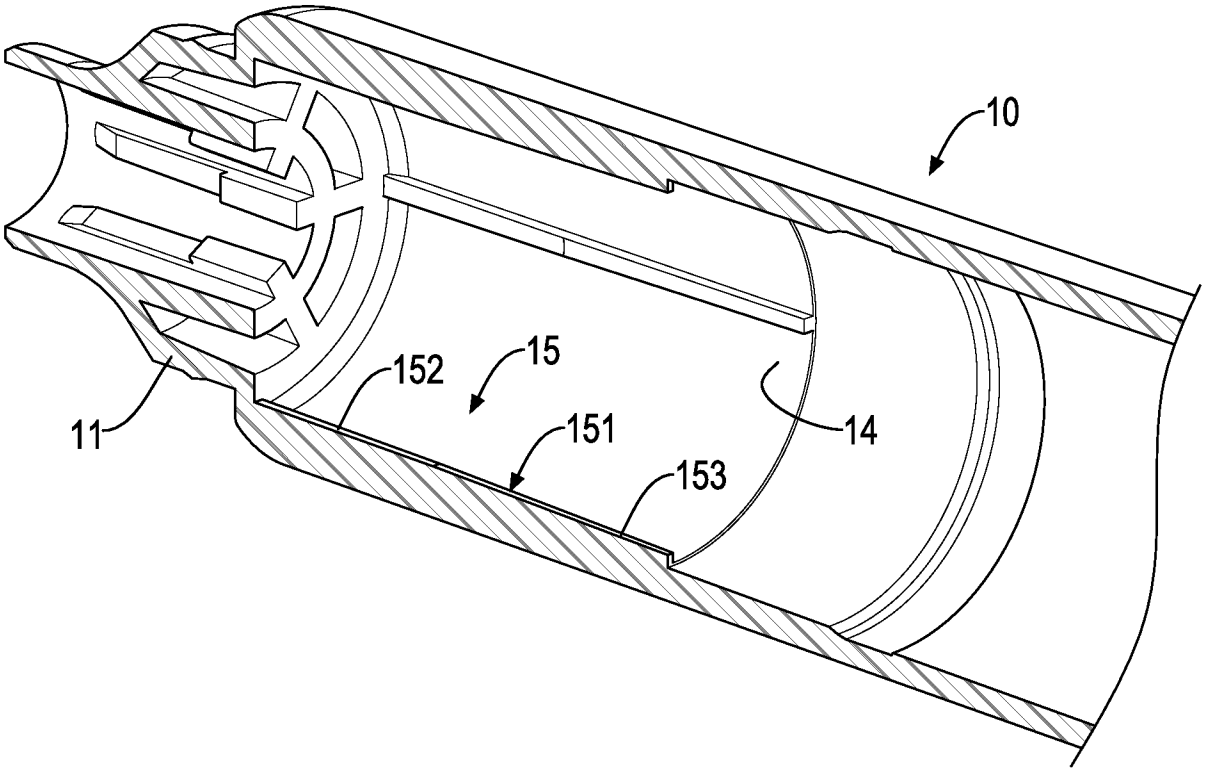
FIG. 3 is a perspective sectional view of a pen tube of the writing tool.
Figure 4:
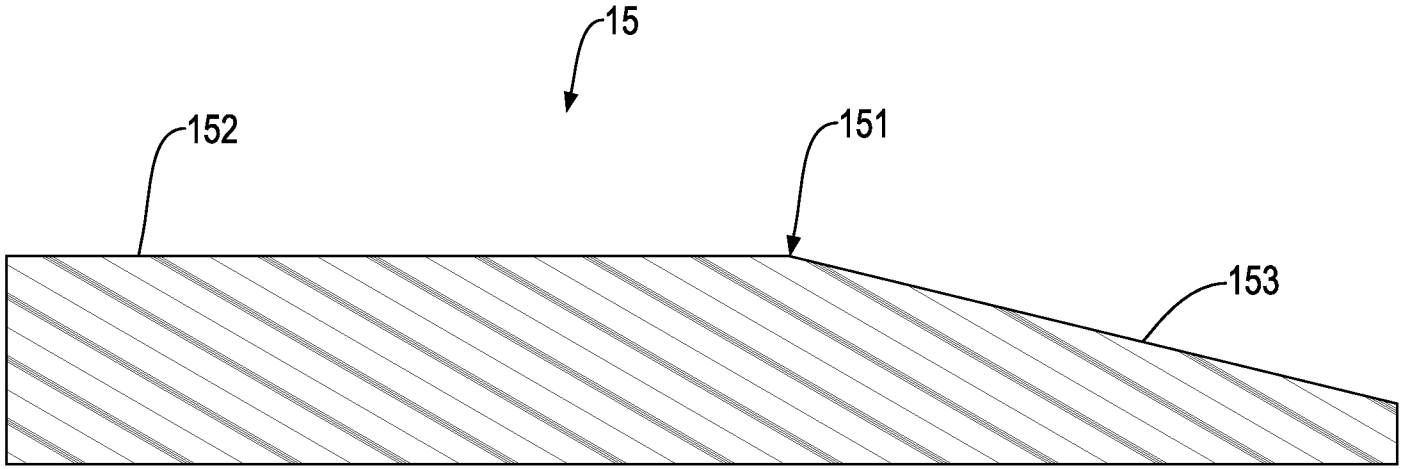
FIG. 4 is an exaggerated side sectional view of the pen tube of the writing tool.

With reference to FIG. 2, the capillary unit 30 is mounted in the pen tube 10, and an end of the capillary unit 30 is connected to the nib 13 to allow the ink in the ink cartridge 20 to be dispensed to the nib 13. In a preferred embodiment as shown in FIGS. 3 and 4, each of the protrusive ribs 151 has a first segment 152 and a second segment 153 abutting the first segment 152. The first segment 152 is closer to the nib 13 than the second segment 153. A distance for which the first segment 152 of the pressing portion 15 protrudes inwardly is constant, and a distance for which the second segment 153 of the pressing portion 15 protrudes inwardly gradually increases toward the nib 13, namely an inclined or arc-shaped portion being formed between two ends of the second segment 153 lengthwise, so that the first segment 152 of the pressing portion 15 presses a lower half of the capillary unit 30 as shown in FIG. 2. Thus, an upper half of the capillary unit 30 is not pressed but the lower half thereof is partially pressed, thereby forming an outer high-density region on the capillary unit 30 where the capillary unit 30 is pressed by the pressing portion 15. It is to be noted that the inclined angle of the second segment 153 in FIG. 4 is not realistic but exaggerated in proportion instead for clearly showing the distance for which the second segment 153 of the pressing portion 15 protrudes inwardly gradually increases toward the nib 13.

Figure 5:
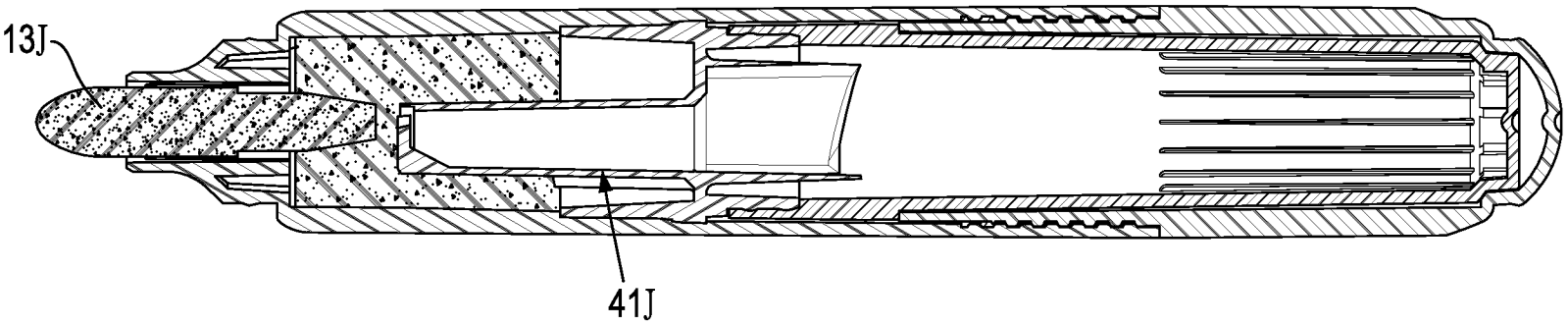
FIG. 5 is a front sectional view of the writing tool in accordance with another preferred embodiment of the present invention.
Figure 6:
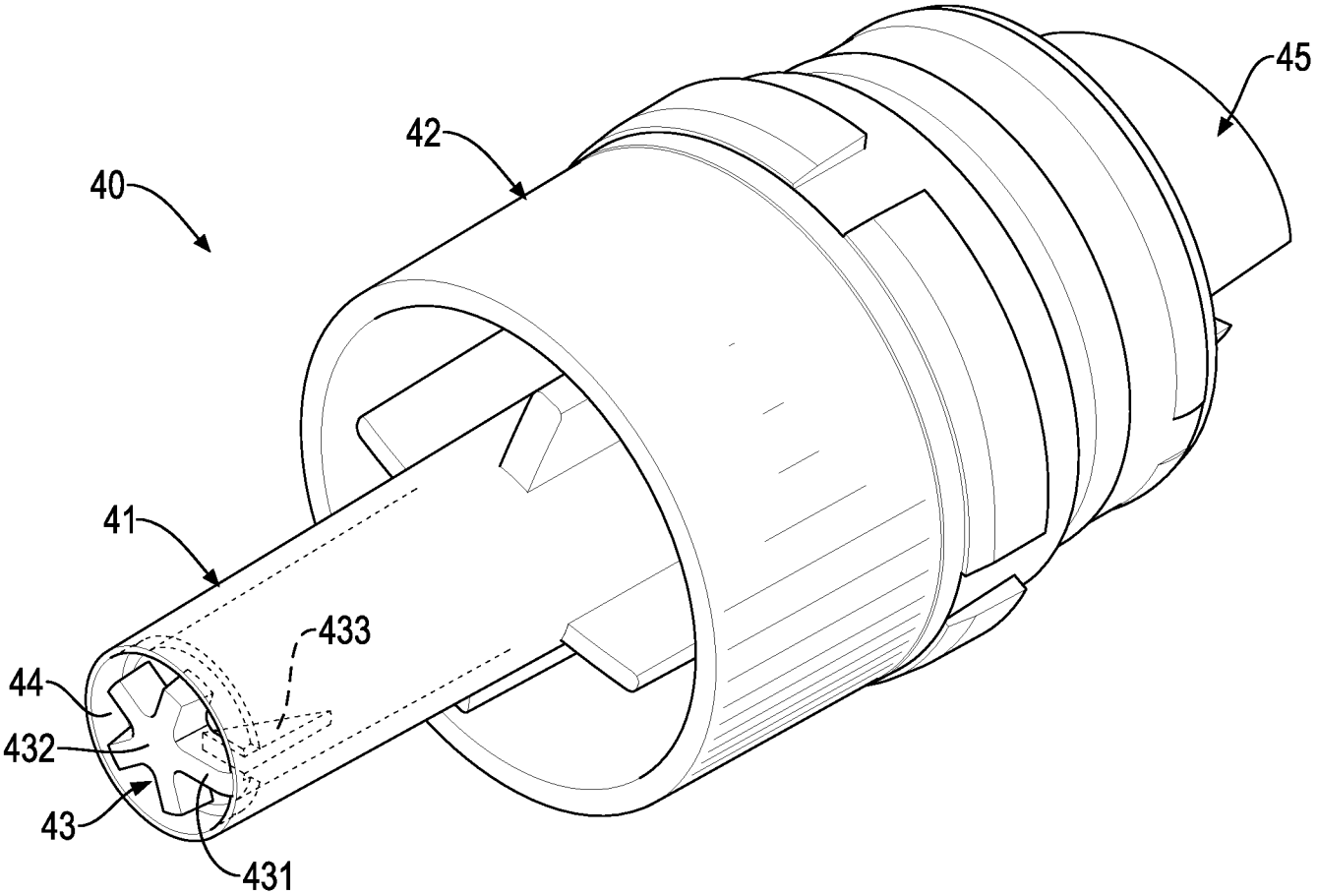
FIG. 6 is a perspective view of a dispensing unit of the writing tool.
Figure 7:
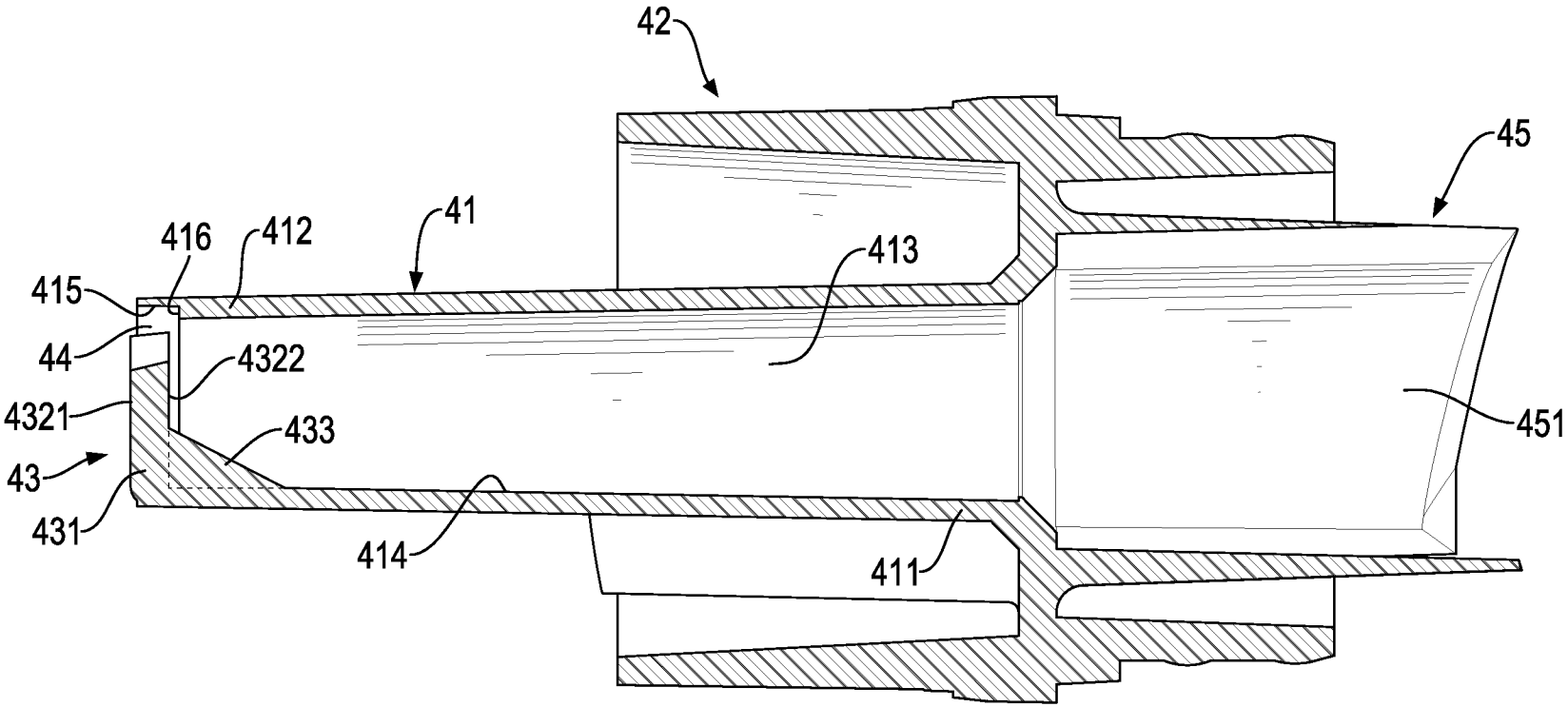
FIG. 7 is a front sectional view of the dispensing unit of the writing tool.

With reference to FIGS. 6 and 7, the dispensing unit 40 is mounted in the pen tube 10 for communication between the ink cartridge 20 and the capillary unit 30. The dispensing unit 40 has a communicating tube 41, a fixing segment 42, a pressing segment 43, a dispensing interval 44, and a cutting segment 45. The fixing segment 42 is a hollow tube and surrounds the communicating tube 41. The communicating tube 41 is a tube extending lengthwise. The communicating tube 41 and the nib 13 are coaxial with each other. Alternatively, the communicating tube 41J and the nib 13J can be not coaxial with each other as shown in FIG. 5. The communicating tube 41 includes a connecting end 411 and a dispensing end 412 at two ends thereof, respectively. The communicating tube 41 has a dispensing passage 413 and an internal periphery 414. The connecting end 411 and the dispensing end 412 communicate with each other via the dispensing passage 413. The internal periphery 414 surrounds the dispensing passage 413. The communicating tube 41 further has an inner groove 415 formed at a front end face of the internal periphery 414 and adjacent to the dispensing end 412. A bottom surface of the inner groove 415 is defined as a dispensing surface 416. In a preferred embodiment, the dispensing surface 416 is perpendicular to the lengthwise direction of the pen tube 10, and the dispensing surface 416 is a level surface. However, in another preferred embodiment, the dispensing surface 416 can be non-perpendicular to the lengthwise direction of the pen tube 10, and the dispensing surface 416 is an unlevel surface. When the dispensing surface 416 is an unlevel surface, the dispensing surface 416 has a lowest part and a highest part, forming a height difference between the lowest part and the highest part. The dispensing surface 416 may be a curved surface, a planar surface, a wavy surface, an inclined surface, or a combination of at least two of the same.

With reference to FIGS. 6 and 7, the dispensing unit 40 can be engaged in the pen tube 10 via the fixing segment 42 and connected to the ink cartridge 20. The communicating tube 41 communicates with the capillary unit 30 via the dispensing end 412, and communicates with the ink cartridge 20 via the connecting end 411, so the ink in the ink cartridge 20 can be dispensed to the capillary unit 30 via the dispensing passage 413. An inner high-density region is formed on the capillary unit 30 and located where the capillary unit 30 is pressed by the communicating tube 41.

With reference to FIGS. 2, 6, and 7, the pressing segment 43 is connected to the dispensing end 412 of the communicating tube 41 and contacts the capillary unit 30. The pressing segment 43 has at least one connecting arm 431, at least one abutting segment 432, and at least one strengthening segment 433. Numbers of the at least one connecting arm 431, the at least one abutting segment 432, and the at least one strengthening segment 433 are adjustable as it depends. In a preferred embodiment, the pressing segment 43 has one said connecting arm 431, one said abutting segment 432, and one said strengthening segment 433. The connecting arm 431 is connected to the internal periphery 414 of the communicating tube 41 and is adjacent to the dispensing end 412. In a preferred embodiment, the connecting arm 431 extends straight to the inner groove 415 of the communicating tube 41. The abutting segment 432 is in the shape of a regular or irregular geometrical block. A side of the abutting segment 432 is connected to the connecting arm 431. A supporting surface 4321 and a guiding surface 4322 are formed on an outer surface and an inner surface of the abutting segment 432, respectively, and opposite to each other. The supporting surface 4321 and the guiding surface 4322 may each be a planar surface or a non-planar surface such as a wavy surface, an arc-shaped surface or an inclined surface. The supporting surface 4321 and the guiding surface 4322 may or may not correspond to each other in shape. The supporting surface 4321 of the abutting segment 432 and an outer surface of the connecting arm 431 may be coplanar or non-coplanar. In other words, the supporting surface 4321 of the abutting segment 432 and the outer surface of the connecting arm 431 may be located on the same plane or different planes. When the supporting surface 4321 of the abutting segment 432 and the outer surface of the connecting arm 431 are located on different planes, a height difference is formed between the abutting segment 432 and the connecting arm 431.

Figure 8:
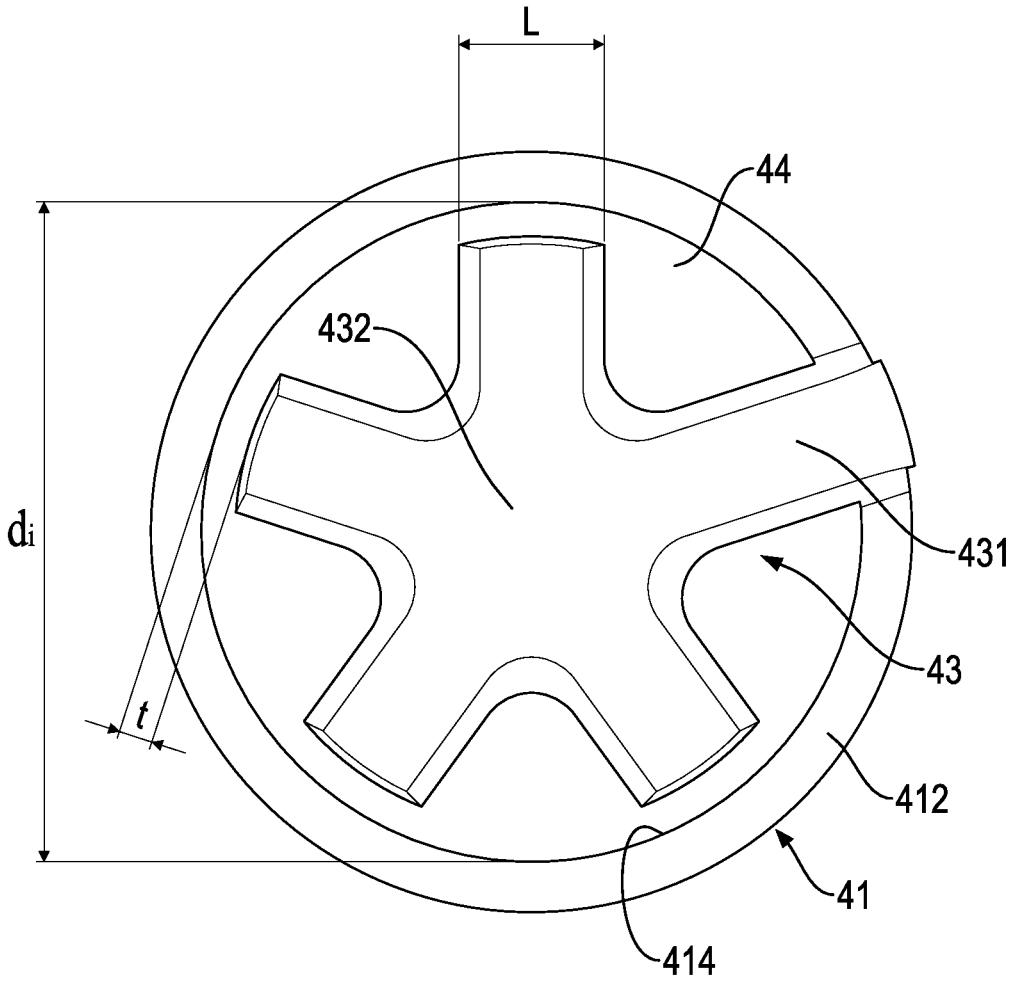
FIG. 8 is a side view of a part of the dispensing unit of the writing tool.
Figure 9:
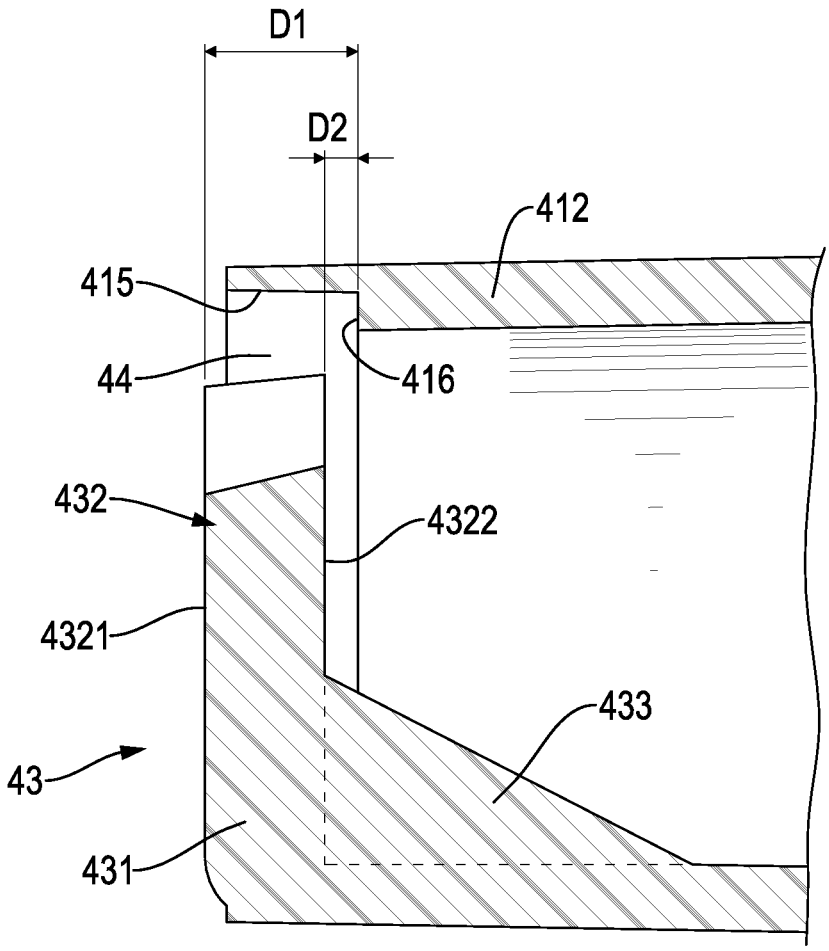
FIG. 9 is an enlarged front sectional view of a part of the dispensing unit of the writing tool.

With reference to FIGS. 7 to 9, in a preferred embodiment, the abutting segment 432 includes four elongated blocks extending radially outwards from a center of the pressing segment 43 and arranged at equiangular intervals. The abutting segment 432 and the connecting arm 431 jointly form a shape like a five-spoke helm. The abutting segment 432 makes its supporting surface 4321 contact and press the capillary unit 30, forming a middle-density region on the capillary unit 30 where the capillary unit 30 is pressed by the supporting surface 4321. The supporting surface 4321 and the guiding surface 4322 are both planar and perpendicular to the lengthwise direction of the communicating tube 41. The supporting surface 4321 is closer to the nib 13 than the dispensing surface 416. A supporting distance D1 is formed between the dispensing surface 416 and the supporting surface 4321. The guiding surface 4322 is located between the dispensing surface 416 and the supporting surface 4321. A guiding interval D2 is formed between the dispensing surface 416 and the guiding surface 4322, and the guiding interval D2 facilitates destruction of the surface tension of the ink, thereby guiding the ink for diffusing it toward the capillary unit 30. The supporting surface 4321 extends beyond an end edge of the dispensing end 412 of the communicating tube 41. The guiding surface 4322 does not extend beyond the end edge of the dispensing end 412 of the communicating tube 41, so the pressing segment 43 can contact the capillary unit 30 earlier than the communicating tube 41.

With reference to FIGS. 6 and 7 again, the strengthening segment 433 is connected with the communicating tube 41 and the pressing segment 43. In a preferred embodiment, the strengthening segment 433 is a triangular block, and two sides of the strengthening segment 433 are integrally connected among the internal periphery 414 of the communicating tube 41, a bottom of the connecting arm 431, and the guiding surface 4322 of the abutting segment 432. The strengthening segment 433 can strengthen the connection between the pressing segment 43 and the communicating tube 41 to enable the connecting arm 431 of the pressing segment 43 to have sufficient structural strength.

With reference to FIGS. 6 and 7 again, the dispensing interval 44 is formed between the pressing segment 43 and the dispensing end 412 of the communicating tube 41. A shape of the dispensing interval 44 depends on shapes of the connecting arm 431 of the pressing segment 43 and the abutting segment 432. In a preferred embodiment, the dispensing interval 44 forms an irregular shape between a periphery of the pressing segment 43 and the dispensing end 412 of the communicating tube 41. The dispensing interval 44 can guide the ink inside the dispensing passage 413 for diffusing toward the capillary unit 30, and a low-density region is formed on the capillary unit 30 and corresponds to the dispensing interval 44. With reference to FIG. 8, the abutting segment 432 includes four protrusions extending toward the internal periphery 414 and each of the four protrusions has a distal side proximal to the internal periphery 414. The dispensing interval 44 defines a width t formed between the internal periphery 414 and a periphery of the abutting segment 432. The width t may be constant or inconstant. The width t is equal to or larger than 0.1 mm, and is smaller than an inner diameter di of the internal periphery 414 of the communicating tube 41. An abutting length L is defined by a distance between two opposite points located at the distal side of either of the four protrusions of the abutting segment 432. The abutting length L is equal to or larger than 0.1 mm, and is smaller than the inner diameter di of the internal periphery 414 of the communicating tube 41.

With reference to FIGS. 6 and 7 again, the cutting segment 45 is connected to the connecting end 411 of the communicating tube 41, and is located at an inner side of the fixing segment 42. The cutting segment 45 has a plurality of cutting blades 451 for piercing and cutting the sealing film of the ink cartridge 20.

Figure 10:
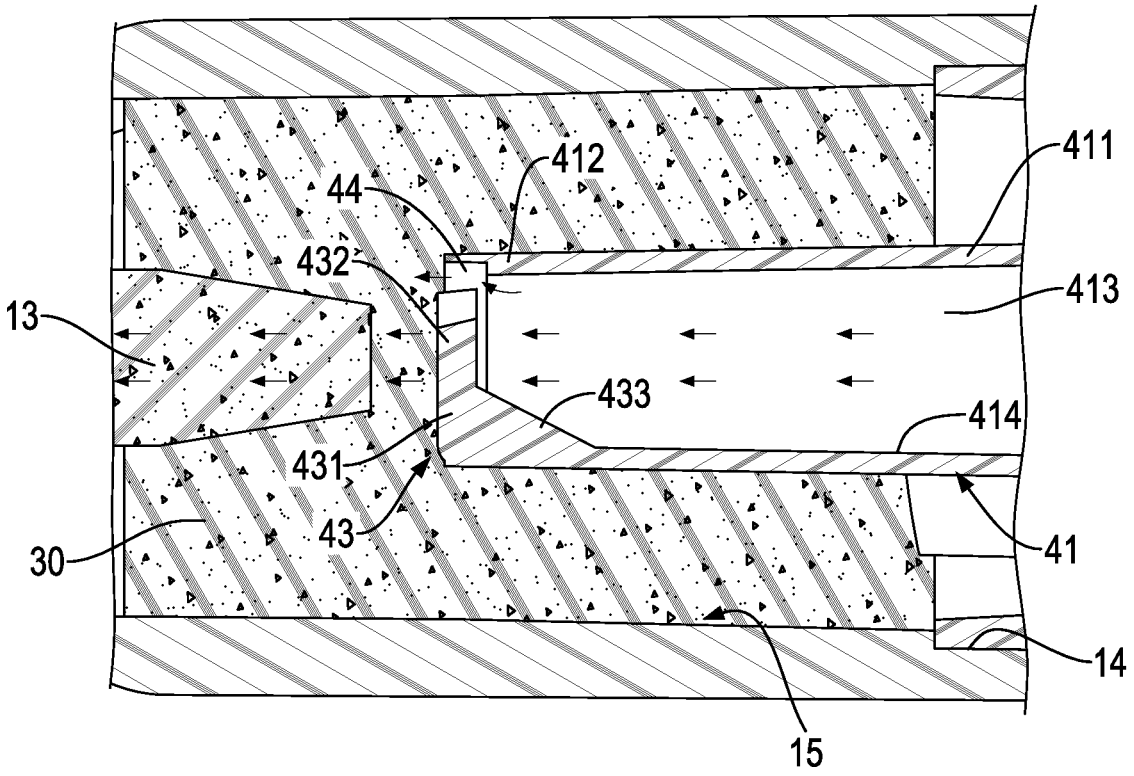
FIG. 10 is a front sectional view of a part of the writing tool in use.

FIGS. 2, 9, and 10 illustrate operational manner and principle of the first embodiment of the present invention. The ink cartridge 20 is mounted in the pen tube 10, and the sealing film of the ink cartridge 20 is pierced and cut by the cutting segment 45 of the dispensing unit 40. Thus, the ink in the ink cartridge 20 flows along the dispensing passage 413 of the communicating tube 41, passes through the dispensing interval 44, and then flows into the capillary unit 30. At last, the ink flowing into the capillary unit 30 is dispensed to the nib 13 for writing.

The dispensing unit 40 makes its pressing segment 43 contact the capillary unit 30. Since the pressing segment 43 forms a cantilever via the connecting arm 431 and the communicating tube 41, the abutting segment 432 elastically abuts the capillary unit 30. In other words, the abutting segment 432 has elasticity while abutting the capillary unit 30. The high-density region, the middle-density region, and the low-density region are formed on the capillary unit 30 and correspond to the communicating tube 41, the pressing segment 43, and the dispensing interval 44, respectively. In this way, the ink can flow into the low-density region of the capillary unit 30. When the low-density region of the capillary unit 30 is full of the ink and the air is occluded, the gas-liquid exchange is stopped. When the ink in the low-density region is decreased due to the writing and the gas-liquid exchange, the remaining ink continues to flow out. The middle-density region of the capillary unit 30 can adjust the pressure of the capillary unit 30 for preventing the superfluous ink from leaking.

In addition, the capillary unit 30 provides a traction for the ink, and the dispensing interval 44 works with the guiding interval D2 between the dispensing surface 416 and the guiding surface 4322 to provide another traction. Thus, the two tractions can destroy the surface tension of the ink to enable the ink to easily and smoothly flow from the communicating tube 41 to the capillary unit 30 for writing through the nib 13.

In addition, when the communicating tube 41 and the nib 13 are not coaxial with each other and the pen tube 10 is laid flat, the pen tube 10 tends to roll to keep the ink at a lower ink-level position of the dispensing passage 413, thus facilitating the ink to flow to the nib 13. In this way, the nib 13 can still be effectively moistened even when the ink is decreased.

As a result, the dispensing unit 40 of the present invention can enable the capillary unit 30 to form different retention regions of the ink. The pressing segment 43 mainly applies an axial pressing force to the capillary unit 30 in order to adjust the pressure of the capillary unit 30 and to reduce the surface tension of the ink, further guiding the ink smoothly for dispensing it out thus supplying appropriate amount of ink, and avoiding the ink leakage. When the ink flows out of the dispensing passage 413, the ink is limited by the communicating tube 41 and the pressing segment 43 to smoothly flow along and through the dispensing interval 44. Such limitation can prevent the lateral overflow of the ink to avoid the ink leakage as well.

Figure 11:
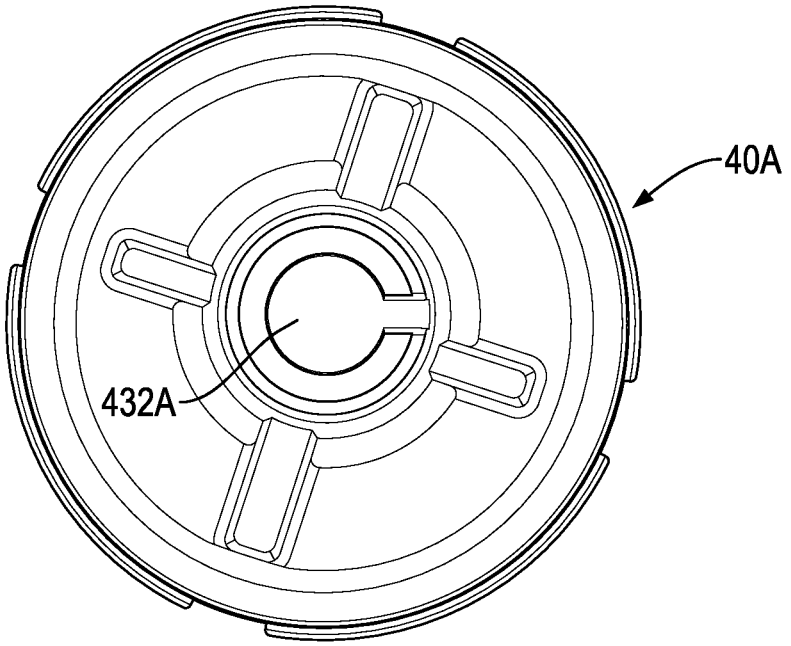
FIG. 11 is a side view of the dispensing unit of the writing tool in accordance with a second preferred embodiment of the present invention.
Figure 12:
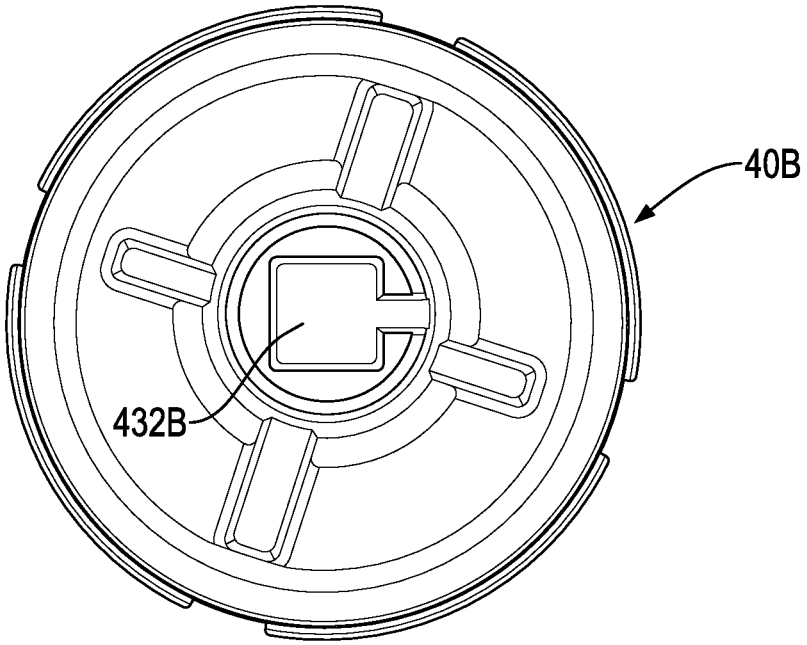
FIG. 12 is a side view of the dispensing unit of the writing tool in accordance with a third preferred embodiment of the present invention.
Figure 13:
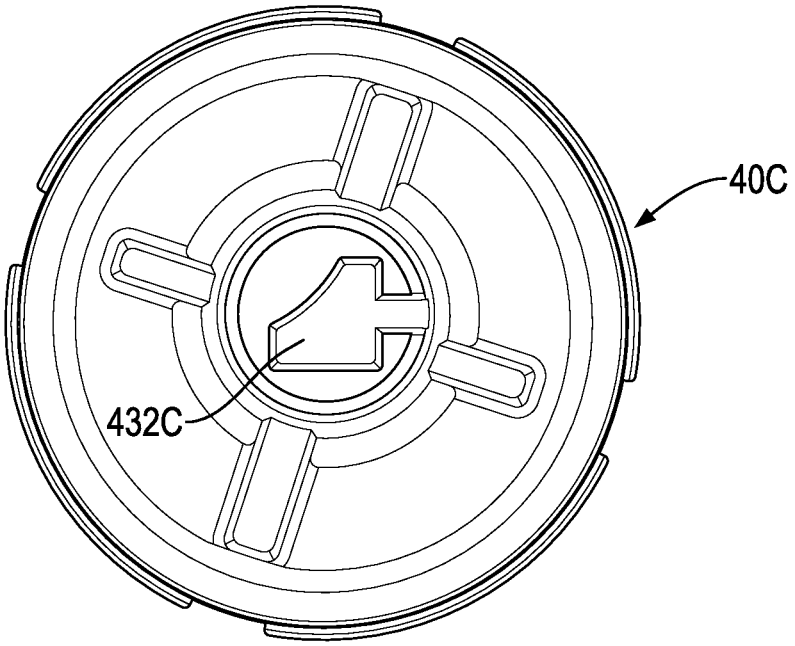
FIG. 13 is a side view of the dispensing unit of the writing tool in accordance with a fourth preferred embodiment of the present invention.
Figure 14:
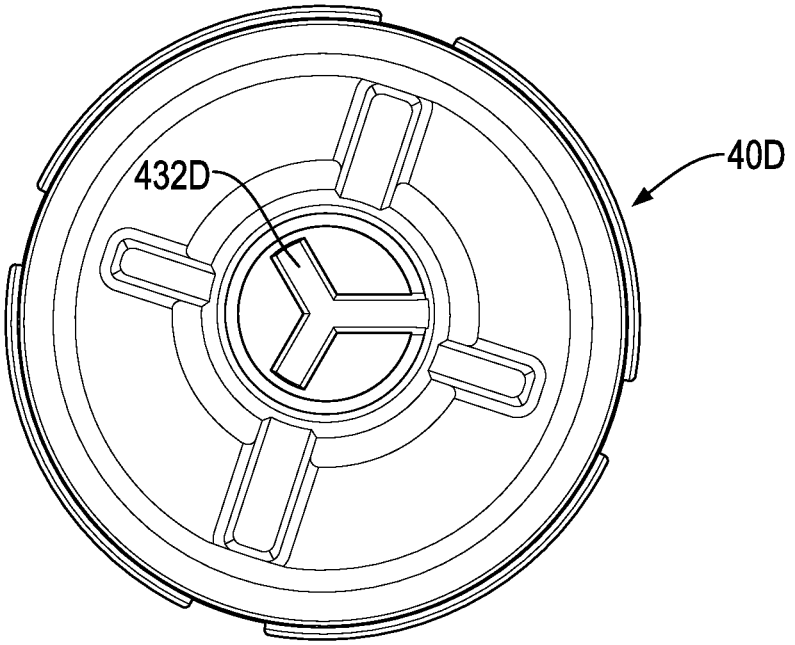
FIG. 14 is a side view of the dispensing unit of the writing tool in accordance with a fifth preferred embodiment of the present invention.
Figure 15:
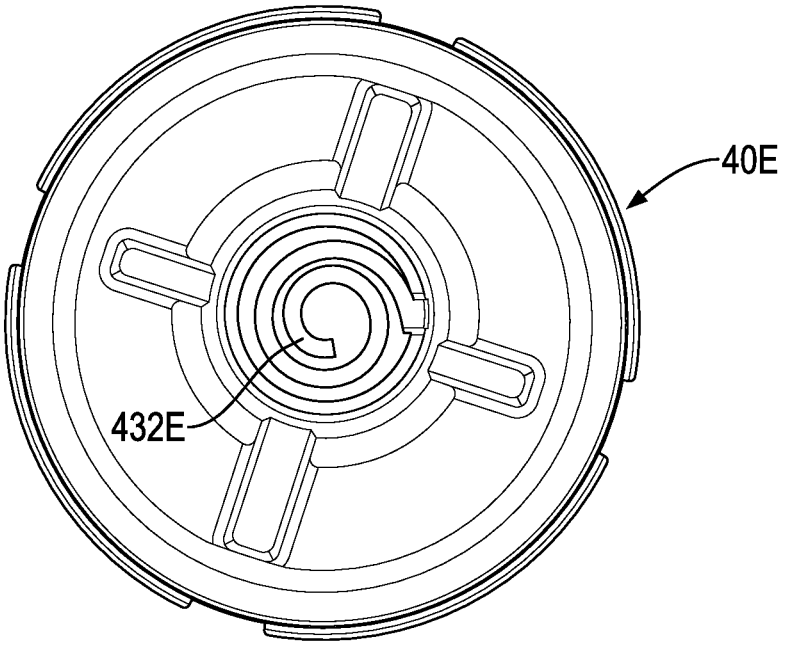
FIG. 15 is a side view of the dispensing unit of the writing tool in accordance with a sixth preferred embodiment of the present invention.

The communicating tube 41 of the dispensing unit 40 of the present invention can have various embodiments. FIGS. 11 to 15 illustrate a second preferred embodiment through a sixth preferred embodiment of the dispensing units 40A, 40B, 40C, 40D, 40E, respectively. The difference between the dispensing unit 40 of the first preferred embodiment and the dispensing units 40A, 40B, 40C, 40D, 40E of the second to sixth preferred embodiments lies in shapes of the abutting segment 432 of the pressing segment 43. The abutting segment 432A shown in FIG. 11 is shaped like a circle sectionally. The abutting segment 432B shown in FIG. 12 is shaped like a rectangle sectionally. The abutting segment 432C shown in FIG. 13 is shaped like a diamond sectionally. The abutting segment 432D shown in FIG. 14 is shaped like V sectionally and has two protrusions. A distance between two opposite points located at a distal side of either of the two protrusions of the abutting segment 432D is the aforementioned abutting length L. The abutting segment 432E shown in FIG. 15 is shaped like a vortex sectionally.

Figure 16:
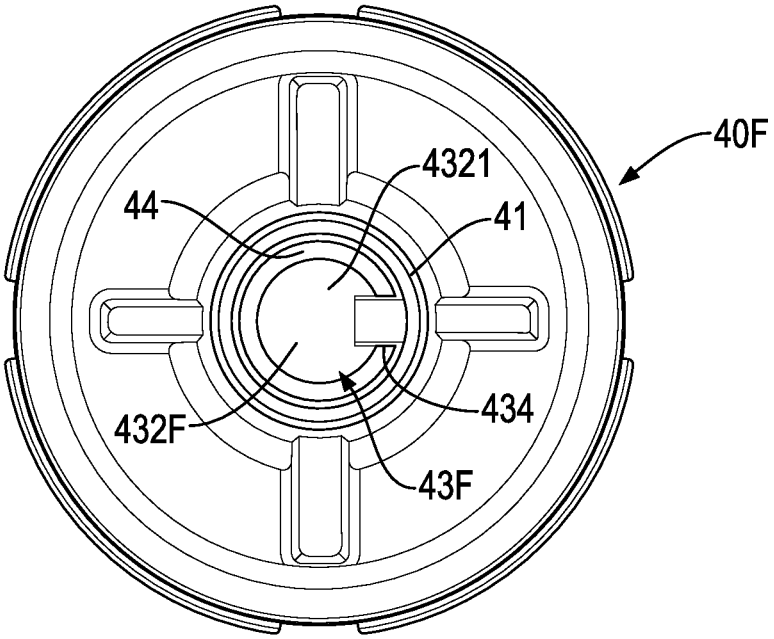
FIG. 16 is a side view of the dispensing unit of the writing tool in accordance with a seventh preferred embodiment of the present invention.
Figure 17:
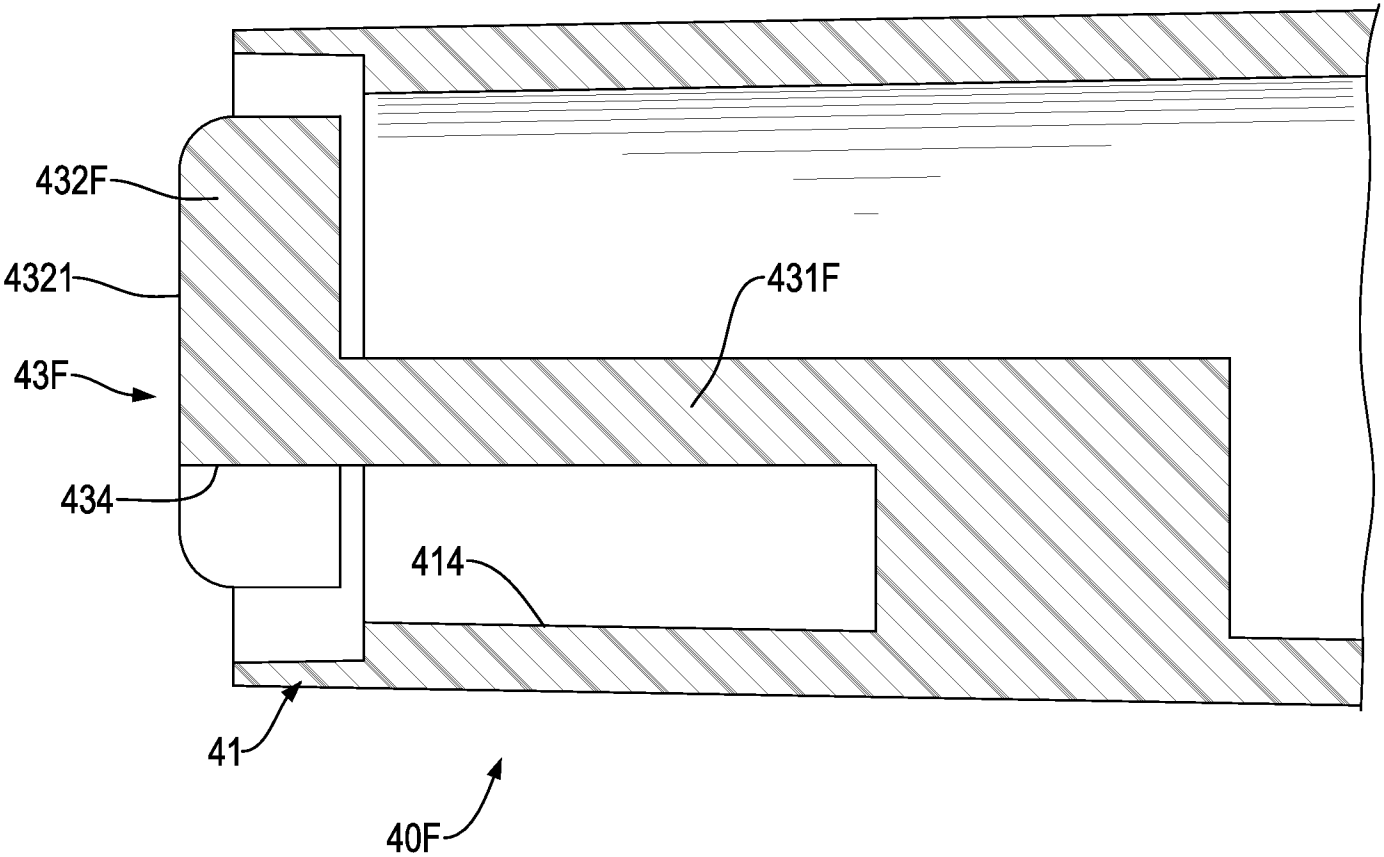
FIG. 17 is a front sectional view of a part of the dispensing unit of the writing tool shown in FIG. 16.

In a seventh preferred embodiment of the present invention as shown in FIGS. 16 and 17, the dispensing unit 40F is similar to those of the other preferred embodiments mentioned thereinbefore, having differences recited thereinafter in terms of the pressing segment 43F. The abutting segment 432F of the pressing segment 43F is shaped like a disk sectionally and has a notch 434 formed at a side thereof. The connecting arm 431F is sectionally L-shaped and has two ends, one of which is connected to a bottom of the abutting segment 432F and the other extends further into the communicating tube 41 to be connected to the internal periphery 414. The dispensing interval 44 is formed between the abutting segment 432F and the internal periphery 414, and communicates with the notch 434, thereby allowing the ink to be dispensed through the notch 434. An area of the supporting surface 4321 of the abutting segment 432F is larger than those of the other preferred embodiments mentioned thereinbefore, thereby effectively enlarging the contact area between the abutting segment 432F and the capillary unit 30.

Figure 18:
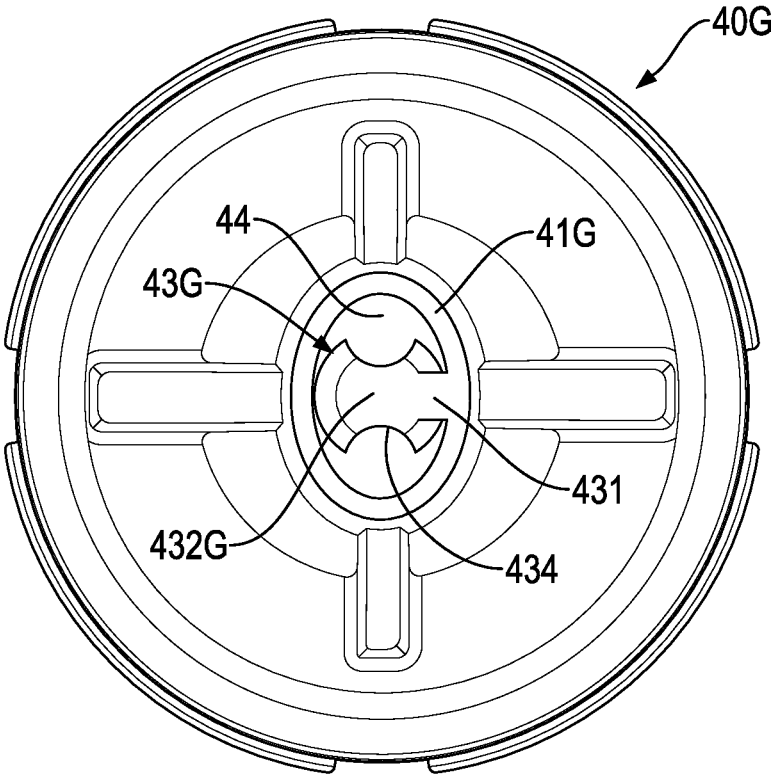
FIG. 18 is a side view of the dispensing unit of the writing tool in accordance with an eighth preferred embodiment of the present invention.
Figure 19:
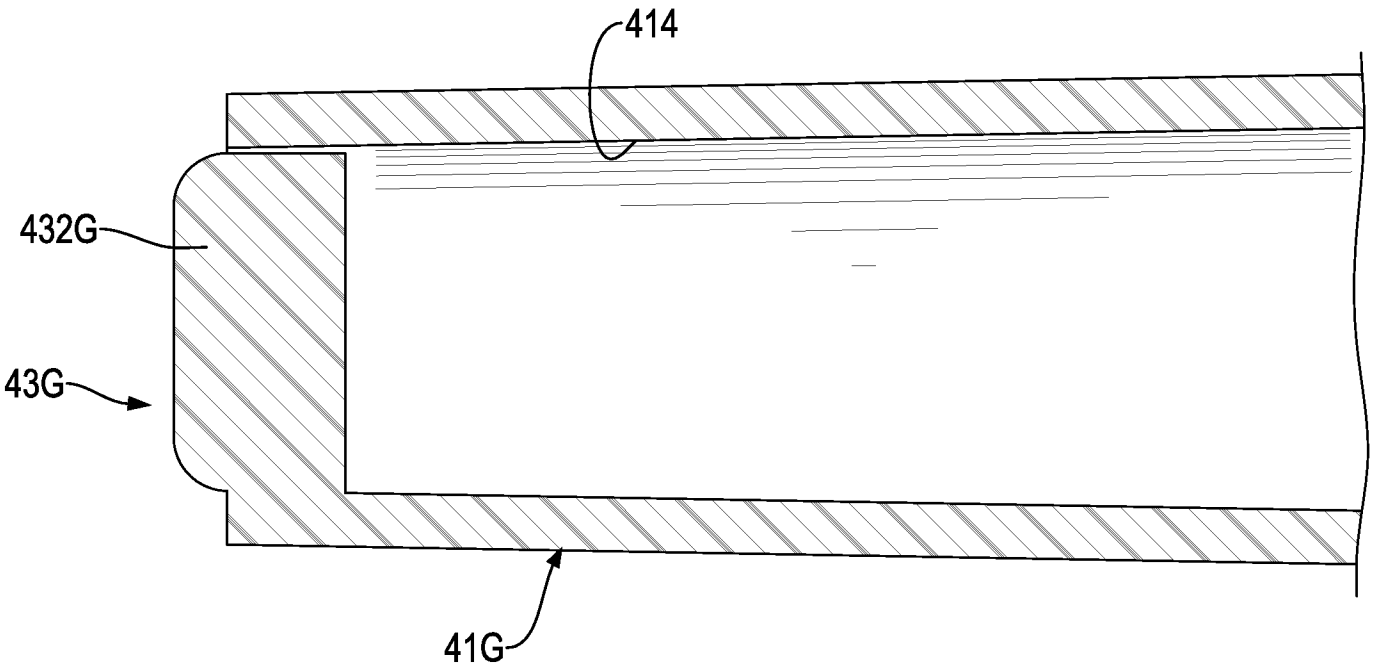
FIG. 19 is a front sectional view of a part of the dispensing unit of the writing tool shown in FIG. 18.

In the eighth preferred embodiment of the present invention as shown in FIGS. 18 and 19, the dispensing unit 40G is similar to those of the other preferred embodiments mentioned thereinbefore, having differences recited thereinafter in terms of the communicating tube 41G and the pressing segment 43G. The communicating tube 41G is sectionally shaped like an oval. The abutting segment 432G of the pressing segment 43G is sectionally shaped like a capsule having two symmetrical round notches 434 formed on two opposite sides thereof. The abutting segment 432G is connected to the internal periphery 414 of the communicating tube 41G via the connecting arm 431, and makes the shape of the dispensing interval 44 similar to two holes that communicate with each other. The dispensing unit 40G not only enlarges the contact area between the abutting segment 432G and the capillary unit 30, but also effectively dispenses the ink through the dispensing interval 44.

Figure 20:
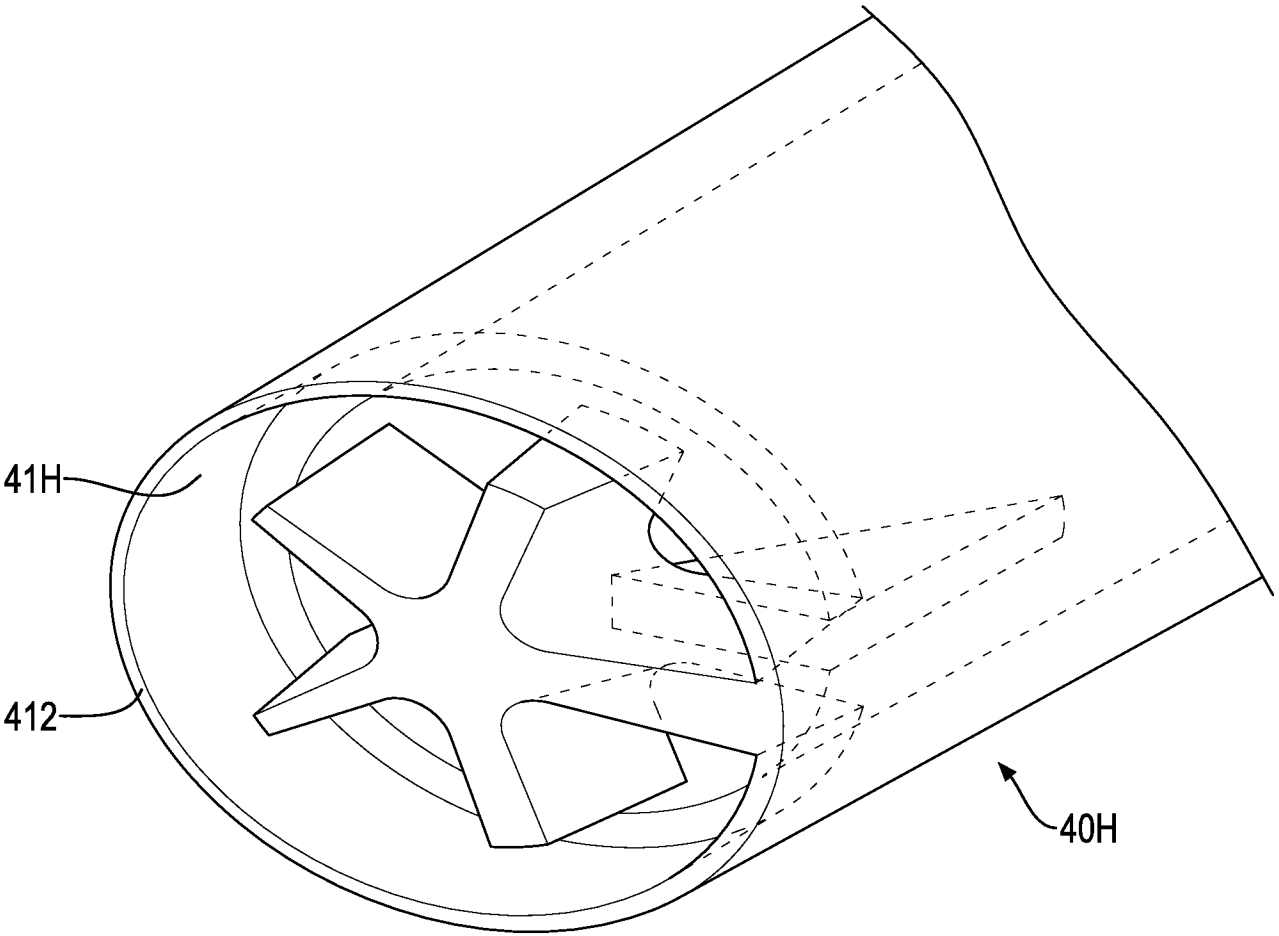
FIG. 20 is a perspective schematic view of a part of the dispensing unit of the writing tool in accordance with a ninth preferred embodiment of the present invention.
Figure 21:
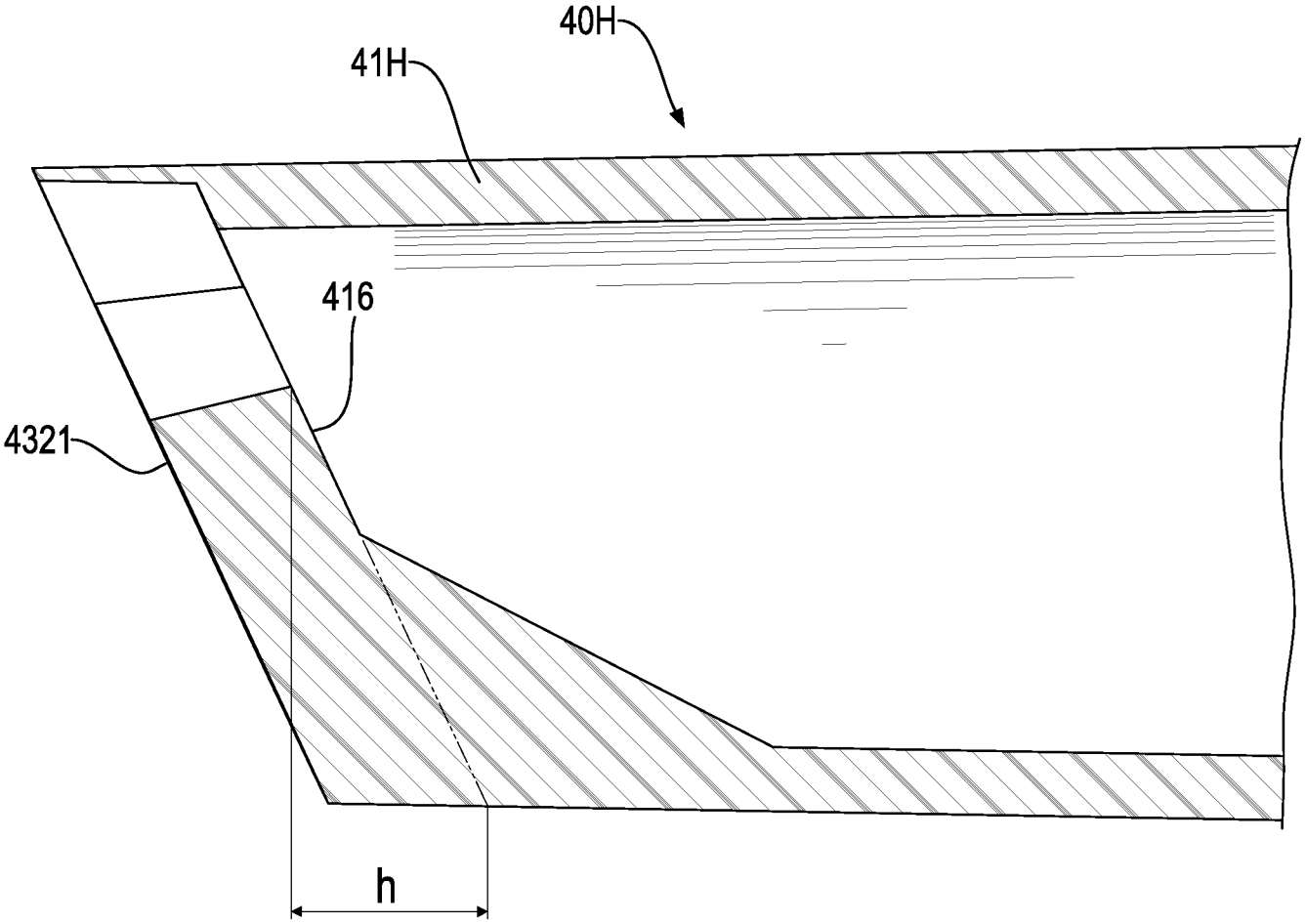
FIG. 21 is a front sectional view of a part of the dispensing unit of the writing tool shown in FIG. 20.

In the ninth preferred embodiment of the present invention as shown in FIGS. 20 and 21, the dispensing unit 40H is similar to that of the first preferred embodiment mentioned thereinbefore, having difference recited thereinafter. The dispensing end 412 of the communicating tube 41H of the dispensing unit 40H is an inclined elliptic surface, and the dispensing surface 416 and the communicating tube 41H are non-perpendicular to each other in lengthwise direction. In addition, the dispensing surface 416 is an unlevel surface, and the dispensing surface 416 has a lowest part and a highest part. A height difference h is formed between the lowest part and the highest part, and can generate a guiding effect of uneven pressures to a liquid surface of the ink for destructing the retention of the ink detained by the surface tension. The larger the height difference h, the stronger the destruction to the surface tension of the ink. Thus, a better dispensing effect for the residual ink is achieved to facilitate smooth dispensing of the last residual ink. Furthermore, the inclined surface of the dispensing end 412 enables the capillary unit 30 to form multi-density regions of different heights and different fiber compactness degrees while pressing the capillary unit 30. Furthermore, the supporting surface 4321 and the communicating tube 41H are non-perpendicular to each other in lengthwise direction.

Figure 22:
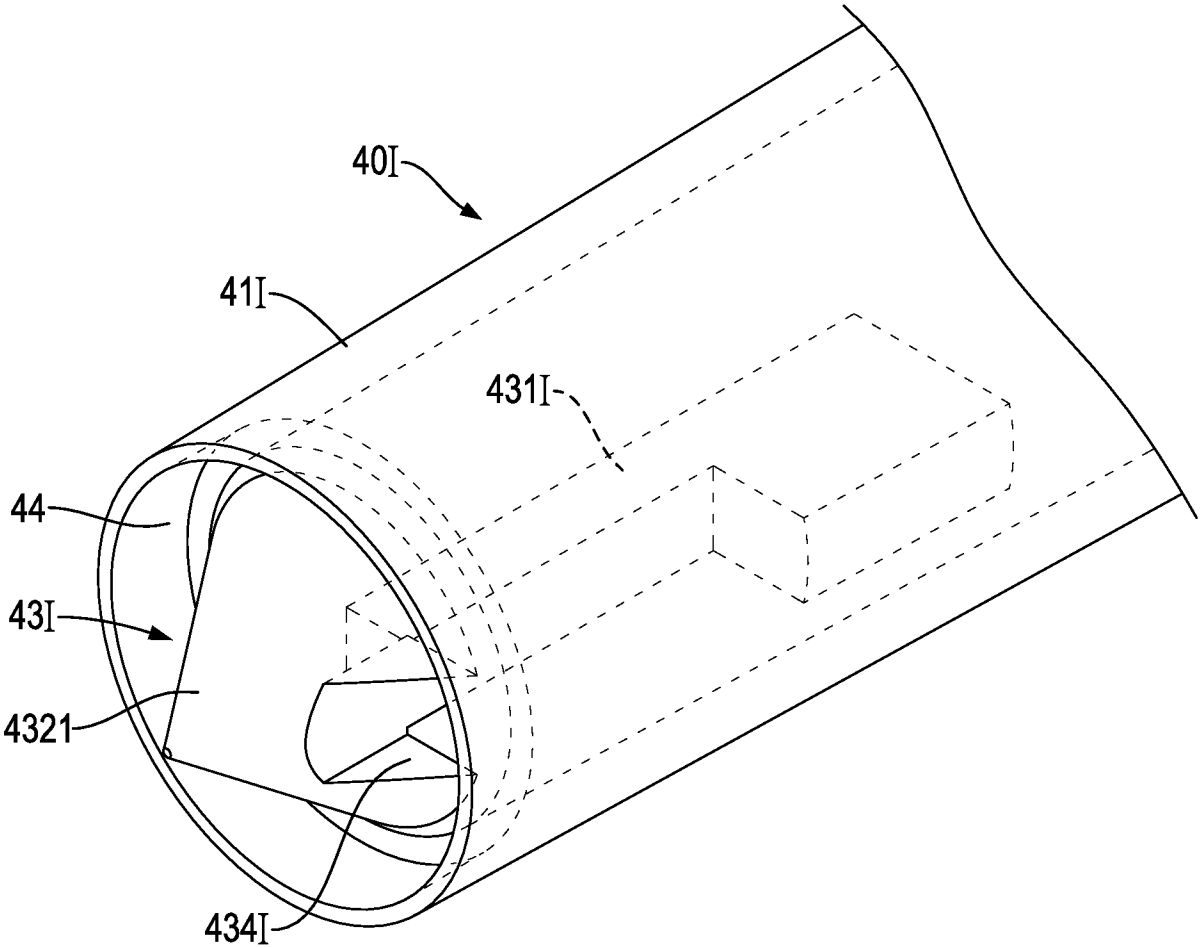
FIG. 22 is a perspective schematic view of a part of the dispensing unit of the writing tool in accordance with a tenth preferred embodiment of the present invention.
Figure 23:
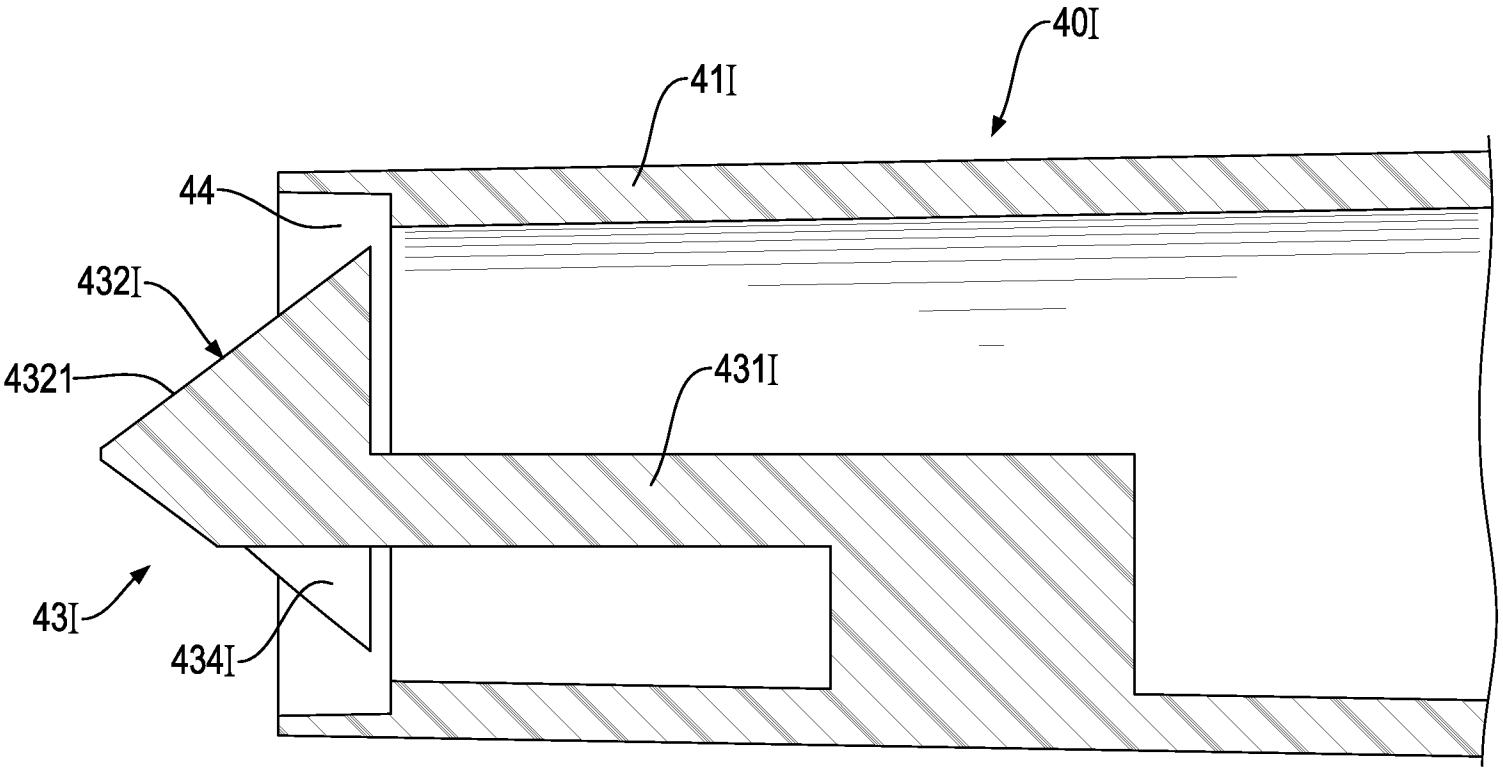
FIG. 23 is a front sectional view of a part of the dispensing unit of the writing tool shown in FIG. 22.

In the tenth preferred embodiment of the present invention as shown in FIGS. 22 and 23, the dispensing unit 40I is similar to that of the first preferred embodiment mentioned thereinbefore, having differences recited thereinafter in terms of the shape of the pressing segment 43I of the dispensing unit 40I. The connecting arm 431I is approximately L-shaped sectionally. An end of the connecting arm 431I is connected to an inner surface of the communicating tube 41I, and another end of the connecting arm 431I is connected to a bottom of the abutting segment 432I. The abutting segment 432I is shaped like a cone, so the supporting surface 4321 is approximately conical. A notch 434I is formed at a side of the abutting segment 432I and communicates with the communicating tube 41I. The contact area between the abutting segment 432I and the capillary unit 30 is enlarged due to the conical supporting surface 4321. The dispensing interval 44 and the notch 434I facilitate dispensing the ink effectively.

As known from the preferred embodiments of the present invention mentioned thereinbefore, the pressing segments 43 of the dispensing units in the aforesaid preferred embodiments can generate and apply pressing forces to the capillary unit 30 by means of the connecting arms in different shapes or the abutting segments in different shapes to enable the capillary unit 30 to form the regions having multiple densities. The structure of the pressing segment 43 is not limited to any of the aforesaid preferred embodiments of the present invention. Furthermore, the ink cartridge 20 of the present invention can be either detachable or undetachable.

Even though numerous characteristics and advantages of the present invention have been set forth in the foregoing description, together with details of the structures and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A writing tool comprising:

a pen tube having a nib mounted to an end of the pen tube;

an ink cartridge mounted to another end of the pen tube and opposite to the nib;

a capillary unit mounted in the pen tube and between the ink cartridge and the nib; an end of the capillary unit being connected to the nib; and a dispensing unit mounted in the pen tube, disposed between the capillary unit and the ink cartridge, and having a communicating tube having an internal periphery;

a channel surrounded by the internal periphery; and a dispensing end facing the nib;

a pressing segment mounted to the dispensing end, contacting the capillary unit, and having at least one abutting segment having a supporting surface contacting the capillary unit; and at least one connecting arm connecting the at least one abutting segment and the internal periphery; and a dispensing interval formed between the at least one abutting segment and the internal periphery.

2. The writing tool as claimed in claim 1, wherein the communicating tube and the nib are not coaxial with each other.

3. The writing tool as claimed in claim 1, wherein the communicating tube has a dispensing surface, the supporting surface being closer to the nib than the dispensing surface, a supporting distance being formed between the dispensing surface and the supporting surface.

4. The writing tool as claimed in claim 3, wherein the dispensing surface is non-perpendicular to a lengthwise direction of the pen tube, is an unlevel surface, and has a lowest part and a highest part, a height difference being formed between the lowest part and the highest part.

5. The writing tool as claimed in claim 3, wherein the at least one abutting segment has a guiding surface located between the supporting surface and the dispensing surface, a guiding interval being formed between the dispensing surface and the guiding surface.

6. The writing tool as claimed in claim 5, wherein the supporting surface and the guiding surface are both planar and perpendicular to a lengthwise direction of the communicating tube.

7. The writing tool as claimed in claim 1, wherein the pressing segment further has a strengthening segment connected between the at least one abutting segment and the internal periphery of the communicating tube.

8. The writing tool as claimed in claim 1, wherein an inner high-density region is formed within the capillary unit where the capillary unit is pressed by the communicating tube; the pen tube further has a pressing portion formed at an inner side thereof for pressing the capillary unit, an outer high-density region being formed on the capillary unit where the capillary unit is pressed by the pressing portion.

9. The writing tool as claimed in claim 8, wherein the pressing portion comprises a plurality of first segments and second segments abutting the first segments, respectively; the first segments are closer to the nib than the second segments, a distance for which each of the first segments of the pressing portion protrudes is constant, and a distance for which each of the second segments of the pressing portion protrudes gradually increases toward the nib.

10. The writing tool as claimed in claim 1, wherein an outer surface of the at least one connecting arm and an outer surface of the at least one abutting segment are coplanar.

11. The writing tool as claimed in claim 1, wherein the ink cartridge is detachably mounted to the pen tube.

12. The writing tool as claimed in claim 1, wherein the supporting surface of the pressing segment extends beyond an end edge of the dispensing end of the communicating tube.

13. The writing tool as claimed in claim 1, wherein the at least one abutting segment of the pressing segment elastically abuts the capillary unit.

14. The writing tool as claimed in claim 1, wherein the dispensing interval is provided with a width defined between the internal periphery of the communicating tube and a periphery of the at least one abutting segment, the width being equal to or larger than 0.1 mm and smaller than an inner diameter of the communicating tube.

15. The writing tool as claimed in claim 1, wherein the at least one abutting segment includes at least one protrusion having a distal side extending toward the internal periphery of the communicating tube, an abutting length defined by a distance between two opposite points located at the distal side of the at least one protrusion of the at least one abutting segment being equal to or larger than 0.1 mm and smaller than an inner diameter of the communicating tube.

16. The writing tool as claimed in claim 1, wherein the supporting surface is non-perpendicular to a lengthwise direction of the communicating tube.

17. The writing tool as claimed in claim 1, wherein the at least one connecting arm is sectionally L-shaped and has two ends, one of which is connected to a bottom of the at least one abutting segment and the other extends further into the communicating tube to be connected to the internal periphery of the communicating tube.

18. The writing tool as claimed in claim 1, wherein the at least one abutting segment has at least one notch formed at a side thereof, and the dispensing interval communicates with the at least one notch.

19. The writing tool as claimed in claim 1, wherein the at least one abutting segment is shaped like a cone.

20. The writing tool as claimed in claim 1, wherein the at least one abutting segment is shaped like a vortex sectionally.

* * * * *